US006212801B1

(12) United States Patent
Kellogg et al.

(10) Patent No.: US 6,212,801 B1
(45) Date of Patent: Apr. 10, 2001

(54) REVERSIBLE IRONING BOARD COVER

(75) Inventors: Michael S. Kellogg, Oconomowoc; Dean B. Krotts, Milwaukee, both of WI (US)

(73) Assignee: Bajer Design & Marketing, Inc., Waukesha, WI (US)

( * ) Notice: Subject to any disclaimer, the term of this patent is extended or adjusted under 35 U.S.C. 154(b) by 0 days.

(21) Appl. No.: 09/405,467

(22) Filed: Sep. 24, 1999

(51) Int. Cl.[7] ..... D06F 83/00; D06F 81/14
(52) U.S. Cl. ..... 38/140
(58) Field of Search ..... 38/66, 140, 103

(56) References Cited

U.S. PATENT DOCUMENTS

| | | | |
|---|---|---|---|
| 1,832,545 | 11/1931 | Grant . | |
| 1,844,128 | 2/1932 | La Chapelle . | |
| 1,947,613 | 2/1934 | Northup . | |
| 2,026,961 | 1/1936 | Brodt . | |
| 2,210,601 | 8/1940 | Scanlon . | |
| 2,214,824 | 9/1940 | Smith et al. . | |
| 2,267,112 | 12/1941 | Kovalik . | |
| 2,269,804 | 1/1942 | Allaback . | |
| 2,278,517 | 4/1942 | John . | |
| 2,320,249 | 5/1943 | Smith . | |
| 2,418,969 | 4/1947 | Di Gesare . | |
| 2,539,804 | 1/1951 | Adamec . | |
| 2,664,257 | 7/1953 | Emmett et al. . | |
| 2,741,045 | 4/1956 | Merkin . | |
| 2,850,817 | 9/1958 | Rudd et al. . | |
| 2,874,471 * | 2/1959 | Palmer | 38/140 |
| 3,007,267 | 11/1961 | Goldsmith . | |
| 3,049,826 | 8/1962 | Goldsmith . | |
| 3,603,011 | 9/1971 | Cohen . | |
| 3,636,644 | 1/1972 | Janetzke . | |
| 3,691,661 | 9/1972 | Steinbronn . | |
| 3,733,724 | 5/1973 | Davis . | |
| 3,911,603 | 10/1975 | Lehrman . | |
| 4,043,062 | 8/1977 | Lehrman . | |
| 4,120,914 | 10/1978 | Behnke et al. . | |
| 4,360,984 | 11/1982 | Ruttenberg . | |
| 4,484,400 | 11/1984 | Lehrman . | |
| 4,557,062 | 12/1985 | Mattesky . | |
| 4,621,003 * | 11/1986 | Okane | 38/140 X |
| 4,813,166 | 3/1989 | Drake . | |
| 4,982,516 | 1/1991 | Cervantes . | |
| 5,231,777 | 8/1993 | Mattesky et al. . | |
| 5,371,961 | 12/1994 | Mattesky . | |
| 5,392,543 | 2/1995 | Lehrman . | |
| 5,497,570 | 3/1996 | Burshaw et al. . | |
| 5,566,481 | 10/1996 | Lehrman . | |

FOREIGN PATENT DOCUMENTS

| | | |
|---|---|---|
| 547805 | 5/1956 | (NL) . |

* cited by examiner

*Primary Examiner*—Ismael Izaguirre
(74) *Attorney, Agent, or Firm*—Ryan, Kromholz & Manion, S.C.

(57) ABSTRACT

A reversible cover for use on an ironing board. The cover has an ironing surface on each of two oppositely disposed faces and is attached to the ironing board by way of a cinched, peripheral marginal skirt area. Alternate marginal skirts may also be supplied.

7 Claims, 2 Drawing Sheets

REVERSIBLE IRONING BOARD COVER

BACKGROUND OF THE INVENTION

This invention relates to ironing board covers and particularly to an ironing board cover that is reversible and has two oppositely disposed outer ironing surfaces.

Ironing board covers made from various combinations of fabric material and padding are generally known. Regardless of the fabric combination, the usual cover is provided with but one ironing surface. After repeated use, the typical ironing surface becomes worn, making effective ironing difficult. Further, scorching and staining of the ironing surface may also occur. An ironing board cover in this condition must be replaced for efficient use.

SUMMARY OF THE INVENTION

With the above in mind, it is one of the features of the present invention to provide an ironing board cover having at least two ironing surfaces. Multiple ironing surfaces allow users to receive at least two times the use from the cover as the usual one-sided models. Further, the reversible nature of the cover can provide different fabric patterned surfaces for more aesthetic variety.

In the preferred embodiment of the present invention, the reversible ironing board cover is composed of two typical exposed layers. Immediately between these exposed layers is a padding layer composed of heat resistant material generally known in the manufacture of ironing board covers. Combinations of the various layers may be stitched or secured by other means such as adhesives to one another around their peripheral margins. In the preferred embodiment, the exposed layers and the padding layer are stitched together along each peripheral edge. A separate laterally extending marginal skirt is preferably attached to the resultant three-ply edge to provide an underlying attachment means which, together with a drawcord, secures the cover to the ironing board. A generally U-shaped binder surrounds the unattached peripheral edge of the marginal skirt and additionally contains the drawcord within its U-shaped cavity.

In a second embodiment, it is contemplated that the ironing board cover is provided with a unitary marginal skirt. The marginal skirt in this embodiment is integrally formed from the exposed layers and the padding layer. The three layers extend together to form a laterally extending skirt. A U-shaped binder surrounds the peripheral edges of the exposed layers and padding layer. A drawcord is disposed within the U-shaped cavity formed by the binder. As in the preferred embodiment, the drawcord and the skirt cooperate to secure the cover to the ironing board.

A third embodiment is contemplated wherein the exposed layers extend to form a laterally extending marginal skirt. The padding layer floats freely between the exposed layers and does not form the marginal skirt. A U-shaped binder surrounds and is attached to the peripheral edges of the exposed layers. A drawcord is disposed within the U-shaped cavity formed by the binder. The marginal skirt and drawcord cooperate to secure the cover to the ironing board.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
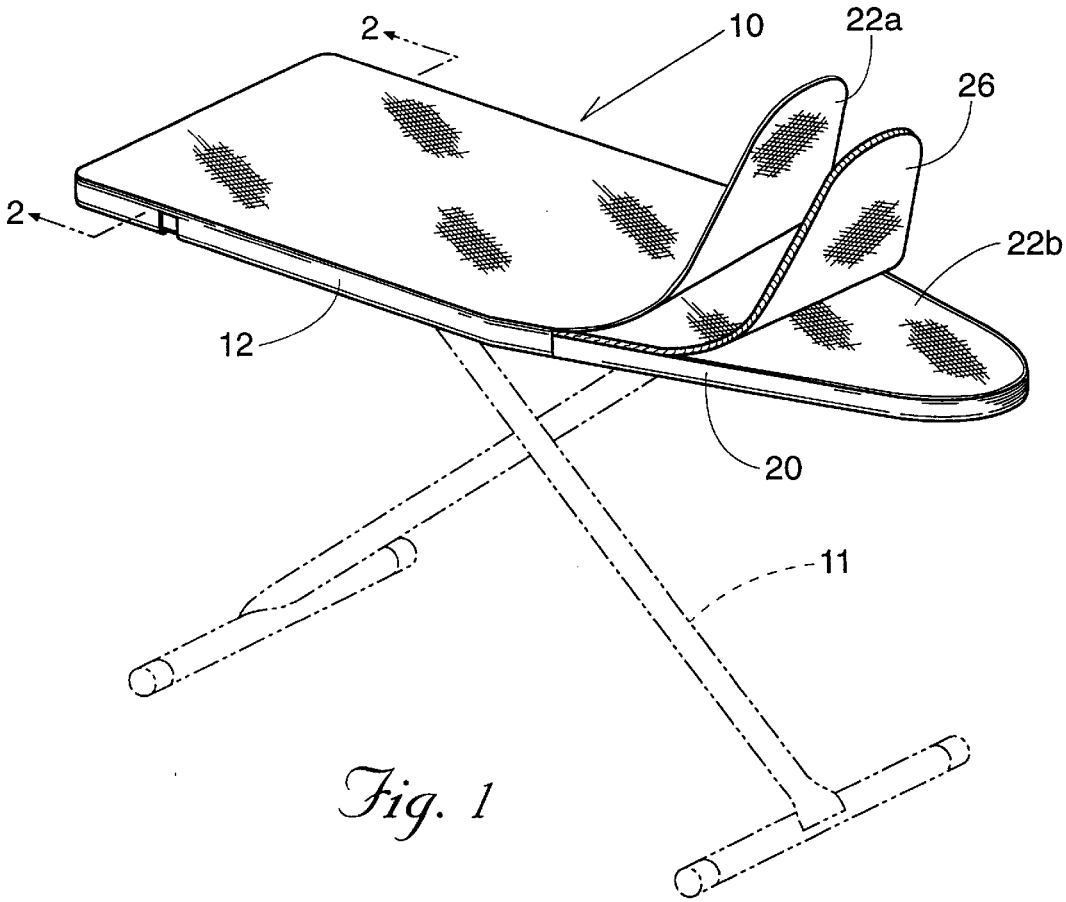
FIG. 1 is a perspective view of a typical ironing board with the cover according to the invention being attached thereto, a peeled away portion is provided to show the reversible nature of the cover.

Referring to FIG. 1, a preferred embodiment of the invention, the reversible ironing board cover 10 having a laterally extending marginal skirt 12, is seen affixed to a standard ironing board 20 with supporting legs 11 being shown in phantom.

Figure 2:
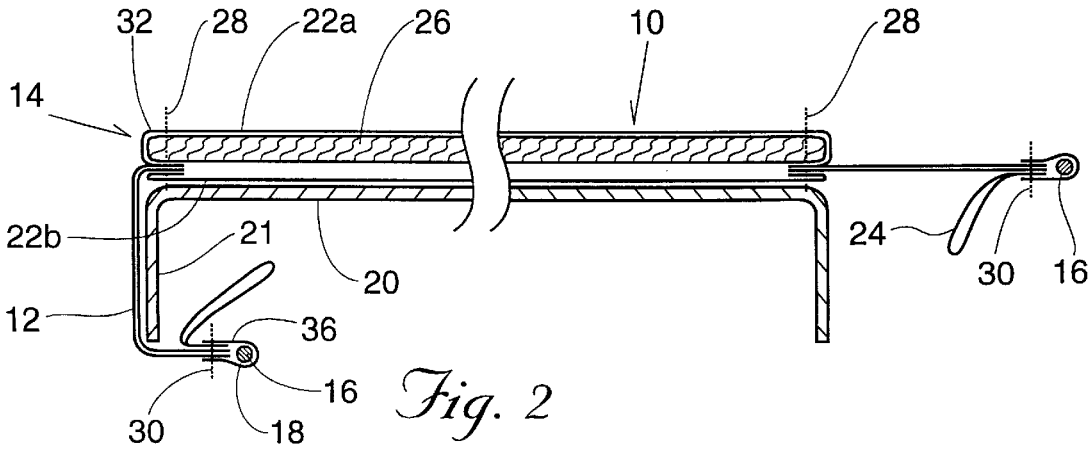
FIG. 2 is a cross sectional view, taken along lines 2—2 of FIG. 1, of the ironing board cover showing the various layers and the laterally extending marginal skirt attached to the exposed layers.
Figure 3:
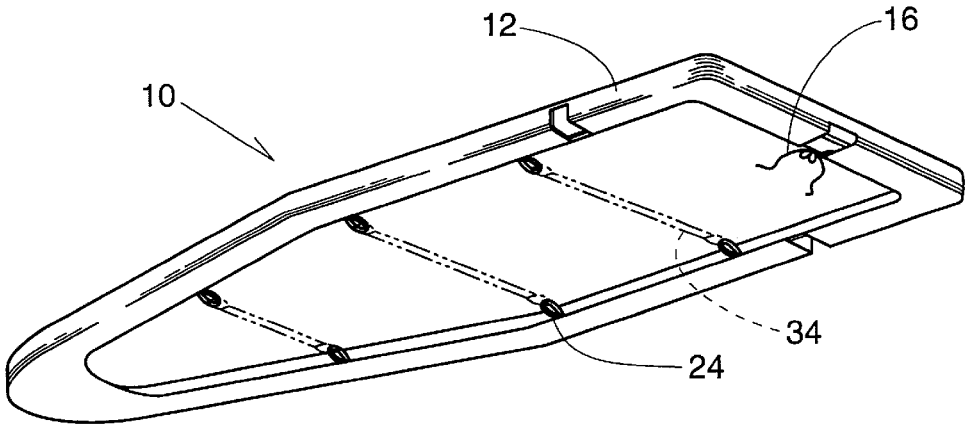
FIG. 3 is a perspective view taken from the underside of an ironing board, and supporting the cover made according to this invention, but with legs removed for ease in more clearly depicting the invention and connective straps shown in phantom.

The cross sectional view of FIG. 2 illustrates the reversible ironing board cover 10 having a plurality of layer members 14. Preferably, the reversible ironing board cover 10 has a shape and size equivalent to the ironing board 20 to be covered, although it must be understood that it could be of any other conventional shape or configuration. The reversible ironing board cover 10 includes a predetermined number of layer members 14, and in the preferred embodiment contains three layers. Each layer member 14 has a size and shape equivalent to the ironing board 20 to be covered, although there may be variations in shape. Two outer or exposed layers 22*a*, 22*b* are attached to the ironing board surface 20 by conventional fastening means, shown in FIGS. 2, 4, and 5 as a drawcord 16 contained within U-shaped binder tape 18. The drawcord 16 is drawn and tied according to conventional practice. Although the drawcord 16 has been found to be the most suitable attachment means, additional attachment may be supplied by elasticized or other binding 34 (shown in phantom in FIG. 3). When elasticized or other binding 34 is used, fastening loops 24 are supplied for attachment. A conventional padding layer 26 is located immediately between the two exposed layers 22*a*, 22*b*. Padding layer 26 is composed preferably of 100% cotton, although a blend of synthetic material such as polyester and cotton may be used in a ratio of 90% cotton and 10% synthetic or 80% cotton and 20% synthetic. Alternatively, a 100% synthetic material with a urethane foam component that provides a heat retardant property may be used. As seen in FIG. 2, stitching 28 is used to connect the exposed layers 22*a*, 22*b* to the padding layer 26. Stitching 30 is used to attach the binder tape 18 to the peripheral ends 36 of marginal skirt 12. In the preferred embodiment, an outwardly extending marginal skirt 12, forms a pocket-like area for securing the reversible cover 10 to the ironing board 20. FIG. 2 depicts the marginal skirt 12 as being a separate fabric section independently attached to the peripheral margin 32 of the exposed layers 22*a*, 22*b* by way of stitching 28. The right side of FIG. 2 depicts the ironing board cover 10, in an extended, unattached state for clarity and to provide more detail of the stitching 28, 30. While this is the preferred configuration, other marginal skirt arrangements have been contemplated.

Figure 4:
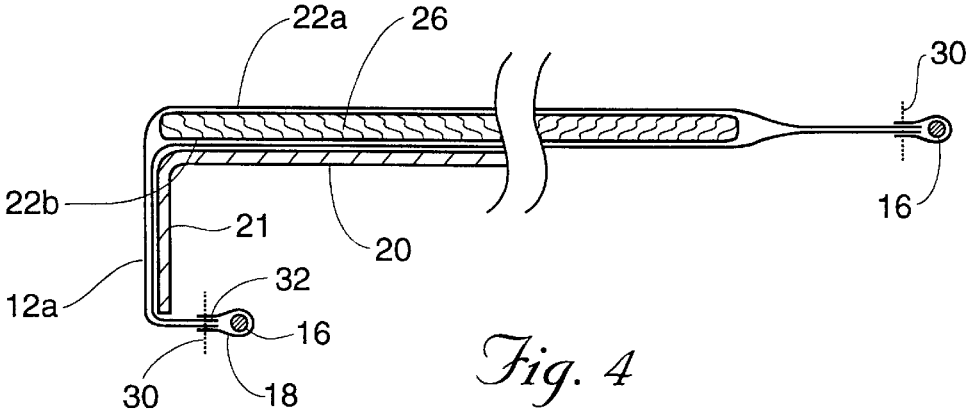
FIG. 4 is a cross sectional view, similar to the view of FIG. 2 and also taken along lines 2—2 of FIG. 1, of the ironing board cover showing the alternate embodiment marginal skirt, integrally formed from the two exposed layers.

FIG. 4 shows an alternate embodiment marginal skirt wherein the skirt 12*a* is formed from the exposed layers 22*a*, 22*b*. The exposed layers 22*a*, 22*b* extend outwardly beyond the intermediate padding layer 26 to integrally form a marginal skirt 12*a*. As in the preferred embodiment, when affixed to an ironing board 20 in use, the marginal skirt 12*a* is bent down around the sides 21 of the ironing board 20 for secure attachment thereto (seen on the left side of FIG. 4). The peripheral margins 32 of the exposed layers 22*a*, 22*b* are secured to one another by way of stitching 30 and within the confines of the generally U-shaped binder tape 18. The right side of FIG. 4 depicts the reversible ironing board cover 10 in an extended, unattached state for clarity and to provide more detail of the stitching 30.

Figure 5:
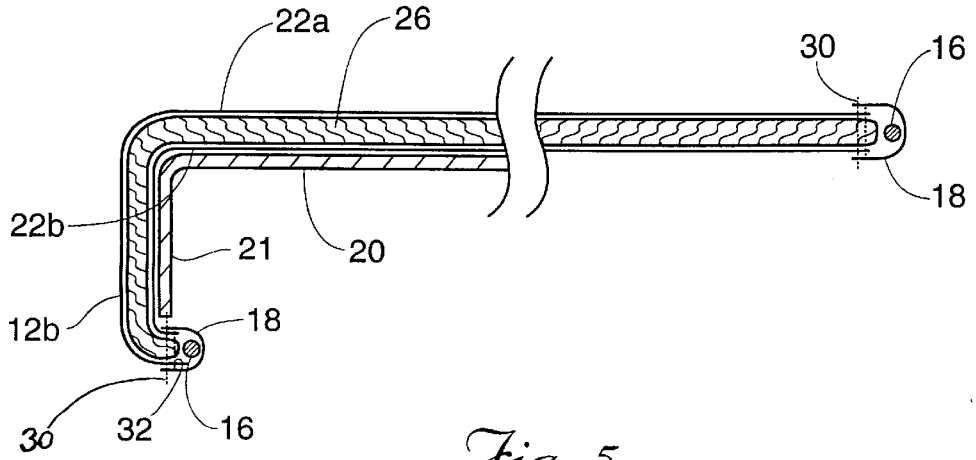
FIG. 5 is a cross sectional view, similar to the views of FIGS. 2 and 4 and also taken along lines 2—2 of FIG. 1, of the ironing board cover showing another embodiment of the marginal skirt, wherein the skirt is formed from the exposed layers and the padding layer.

In another embodiment, seen in cross section in FIG. 5, the exposed layers 22*a*, 22*b* and the intermediate padding layer 26 extend beyond the ironing board periphery to provide a marginal skirt area 12*b*. When affixed to the ironing board 20 in use, (seen on the left side of FIG. 5) the exposed layers 22*a*, 22*b* and padding layer 26 extend down and around the ironing board side 21. The peripheral margins 32 of the exposed layers 22*a*, 22*b* and padding layer 26 are secured to one another by way of stitching 30, which also secures a U-shaped binder tape 18 to the peripheral margin 32. The right side of FIG. 5 shows the ironing board cover 10 prior to being affixed to the ironing board 20 to show the stitching 30 with greater clarity.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A reversible cover for an ironing board, said cover comprising:

a first layer and a second layer, each of said layers including an exposed surface, said first layer further defining a continuous, non-interrupted marginal skirt said marginal skirt being coextensive and integral with said first layer, and extending peripherally around said first layer;

an intermediate padding layer disposed between said first and second layers; and cinch means for securing said reversible cover to said ironing board.

2. The reversible cover of claim 1 wherein said first and second layers are fastened together and wherein said marginal skirt area defines a marginal edge portion of said first layer, and wherein said cover includes an overlaying U-shaped binder tape having oppositely disposed leg portions extending from an intermediate bail portion surrounding and fastened to said marginal edge portion, each of said portions defining the peripheral contour of said first layer.

3. The reversible cover of claim 2 wherein said first and second layers and said padding layer have a configuration substantially conforming to the size and shape of the ironing board to be covered, and wherein said cinch means comprises a draw cord disposed within said bail portion of said binder tape.

4. The reversible cover of claim 2 wherein said marginal skirt is of sufficient width to include a marginal portion thereof underlying an ironing board when said cover is secured thereon.

5. The reversible cover of claim 4 wherein said marginal skirt is further provided with peripherally spaced looped fasteners attached thereto.

6. A reversible cover for an ironing board, said cover comprising:

a first layer and a second layer, each of said layers including an exposed surface and wherein said first and second layers are fastened together and wherein a separate laterally extending, marginal skirt is fastened to said first layer, said skirt surrounding the periphery of said first layer;

an intermediate padding layer disposed between said first and second layers; and cinch means for securing cover to said ironing board.

7. The reversible cover of claim 6 wherein said marginal skirt is further provided with peripherally spaced looped fasteners attached thereto.

* * * * *